US005462469A

United States Patent [19]

Lei

[11] Patent Number: 5,462,469

[45] Date of Patent: Oct. 31, 1995

[54] APPARATUS AND METHOD FOR MAKING BUBBLES

[75] Inventor: Cheong S. Lei, Macau, Macau

[73] Assignee: Jactoys Limited, Kowloon, Hong Kong

[21] Appl. No.: 111,073

[22] Filed: Aug. 24, 1993

[51] Int. Cl.[6] ..... A63H 33/28

[52] U.S. Cl. ..... 446/15

[58] Field of Search ..... 446/15–21

[56] References Cited

U.S. PATENT DOCUMENTS

| | | | |
|---|---|---|---|
| 2,391,797 | 12/1945 | Raspet | 446/21 |
| 2,398,513 | 4/1946 | Bradley | 446/15 |
| 2,989,818 | 6/1961 | Filger et al. | 446/20 |
| 3,210,790 | 10/1965 | Neumann | 446/15 X |
| 3,399,485 | 9/1968 | Cashavelly . | |
| 3,636,652 | 1/1972 | Dumont . | |
| 3,733,736 | 5/1973 | Glessner . | |
| 3,834,066 | 9/1974 | Vargas . | |
| 3,925,923 | 12/1975 | La Fata . | |
| 4,044,496 | 8/1977 | Jernstrom . | |
| 4,556,392 | 12/1985 | Chang . | |
| 4,700,965 | 10/1987 | Kinberg . | |
| 4,808,138 | 2/1989 | von Braunhut . | |
| 4,955,840 | 9/1990 | Moomaw . | |
| 4,988,319 | 1/1991 | Shen . | |

FOREIGN PATENT DOCUMENTS

| | | |
|---|---|---|
| 956110 | 10/1974 | Canada . |
| 2016322 | 11/1991 | Canada . |
| 2078185U | 6/1991 | China . |
| 2092358U | 1/1992 | China . |
| 1509848 | 5/1978 | United Kingdom . |
| 2042350 | 9/1980 | United Kingdom . |
| 2223687 | 4/1990 | United Kingdom . |

*Primary Examiner*—Mickey Yu

*Attorney, Agent, or Firm*—Townsend and Townsend and Crew

[57] ABSTRACT

A bubble making toy comprising a rotatable ring member (34) having a hole (36) for forming a bubble. A pivotable wand element (32) is mounted near the outlet side of the hole and can be pivoted across the face of the hole by actuation of a trigger (12). The toy further includes a pump (14), also actuated by the trigger, for directing a soap mixture from a reservoir (16) to the wand element. The wand element then receives the soap mixture and forms a film of soap over the hole as it pivots across the face of the hole. This construction allows a film of soap will to form over the hole practically every time the trigger is actuated.

14 Claims, 2 Drawing Sheets

APPARATUS AND METHOD FOR MAKING BUBBLES

BACKGROUND OF THE INVENTION

This invention relates to a toy, and in particular, a bubble-making toy.

In UK Patent Document Nos. 2,223,687, 2,042,350, 1,509,848 , U.S. Pat. Nos. 4,044,496, 3,925,923, 3,834,066, 3,733,736, 3,636,652, 4,988,319, 4,955,840, 3,399,485, 4,808,138, 4,700,965 and 4,556,392, Chinese Patent Document Nos. 90214841.9 and 91217493.5, and Canadian Patent Document Nos. 956110 and 2016322, different bubble-producing toys are disclosed.

In some of the prior art arrangements, the bubble-making toys have a reservoir in the form of a trough in which a disc with holes rotates in order to cover each hole with a film of soap. Such arrangements, however, have the disadvantage that they leak when the toy is placed on its side or turned accidentally upside down, and also the provision of a trough type reservoir limits the outer shape of the bubble-making toy that can be adopted.

It is an object of this invention to overcome one or more of these problems.

SUMMARY OF THE INVENTION

In accordance with the invention, a toy comprises means to form a film of soap or the like over a hole, said means including an element which pivots over the face of the hole in order to form the film of soap.

Such an arrangement is advantageous in that the hole over which the film is formed does not have to be situated adjacent to a soap reservoir. Furthermore, the soap reservoir can also be enclosed, thereby stopping any possible leakage.

Suitably the pivoting element has a length which is at least as great as the diameter of the hole, and this element is pivotable from one side of the hole completely to the other side thereof, such that the film of soap is formed over the whole hole. Advantageously, the hole is provided in a member (e.g. in the form of a ring), and the pivoting element is secured to a point on the ring member such that a film of soap is formed over the whole area of the hole.

Suitably a soap reservoir is provided together with a pump which is actioned by a trigger (preferably manual), and on movement of the trigger, it pumps soap from the soap reservoir to the pivoting element whereafter a layer of soap is laid over the hole. Suitably the trigger also actuates the pivoting element to pivot whereby soap is layered over the hole.

Preferably, batteries are provided to rotate the air blower which forces air through the hole covered with the film of soap in order to form bubbles, which then exit the toy. These batteries can also be used to operate either the air blower and/or pump, or for that matter pivot the pivoting element.

Suitably a switch means is also provided in order to turn on the batteries when such are required.

Suitably, the ring member is rotatable and the pivoting member is connected to the ring such that when the ring rotates, the pivoting member moves across the face of the hole, thereby depositing a film of soap thereon.

Alternatively, the ring member is in a fixed position within the toy, and the pivoting element is rotated independently of the ring member.

The invention will now be described by way of example with reference to the accompanying drawings in which:

DESCRIPTION OF THE PREFERRED EMBODIMENT

The embodiments of FIGS. 1 to 3 and 4 to 6 show bubble-making toys in the form of toy guns. Both toys form bubbles which exit out of the barrel portion of the toys.

Figure 1:
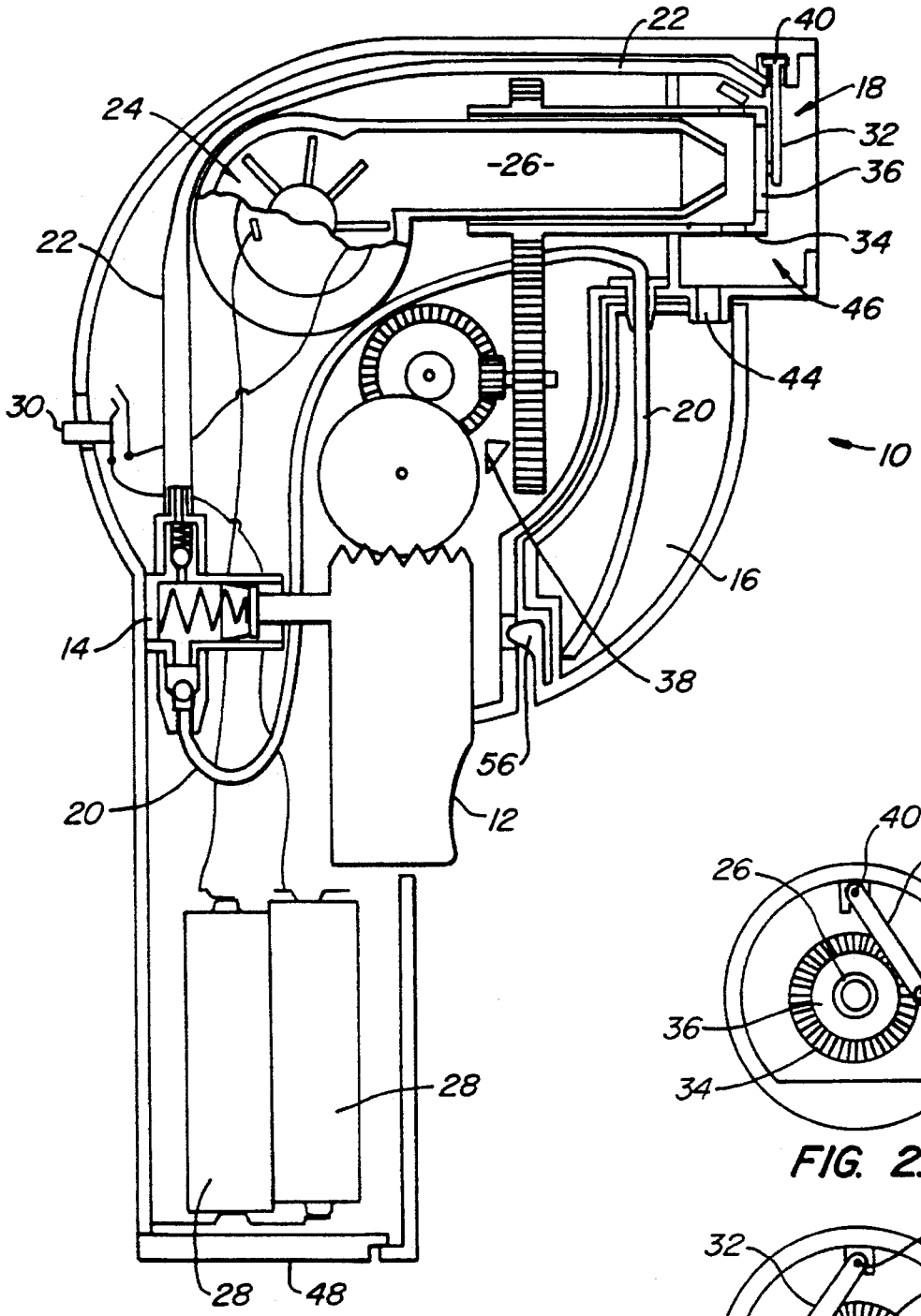
FIG. 1 shows a cross-sectional side view of a first embodiment of bubble maker gun in accordance with the invention.
Figure 2:
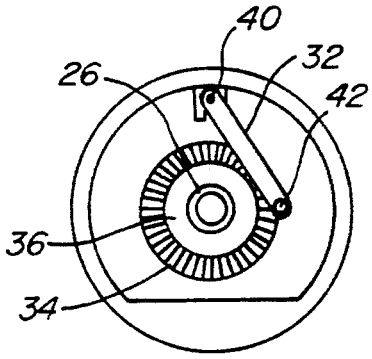
FIG. 2 is an end view of the toy of FIG. 1 showing the pivoting element in a first position.
Figure 3:
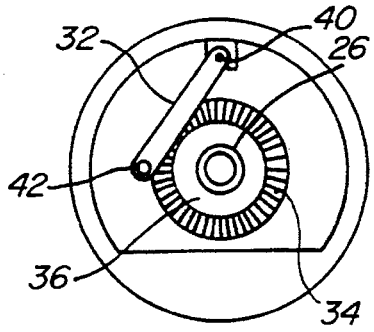
FIG. 3 shows the same view of FIG. 2 but with the pivoting element in a second position.

In the toy 10 of FIGS. 1 to 3, such has a trigger 12 which on manual activation by a finger of the user of the toy operates a pump 14, which pump transfers a soapy water mixture within a reservoir 16 to film-making means 18 via pipes 20 and 22.

The toy 10 is also provided with an air blower 24, and a tunnel 26 to direct air from the air blower towards the film-making means 18, the air blower being operated by a couple of batteries 28 which are switched on/off by a switch 30.

The film-making means 18 comprises two different components, firstly, a freely pivotable "wand" element 32, and secondly, a rotating ring member 34 incorporating a hole 36 over which a film of soapy water is formed, the rotating member 34 being driven by a set of gears 38 engaged ultimately with the top of the trigger 12. In this regard, the rotating member 34 is rotated in one direction approximately 180° (causing the wand 32 to pivot in the same direction approximately 60° ) on pressing of the trigger 12 (see FIG. 3) and on release of the trigger the rotating member rotates back in the other direction approximately 180° (causing the wand 32 to pivot in the same direction approximately 60°—see FIG. 2). The rotating member 34 is co-axial with the tunnel 26 whereby air passing through the tunnel is forced through the hole 36 in the rotating member 34.

The first end 40 of the wand 32 is in a fixed yet pivotable position at the top of the barrel portion of the toy, while the second end 42 of the wand 32 is pivotably secured to a part of the rotating ring member 34, and in particular, is secured at a position which is at the outer circumference of the hole 36. When the rotating ring member 34 rotates, the wand 32 is thus pivoted totally across the outer face of the hole 36 such that a film of soapy water is formed right across the hole. In particular, it will be seen in FIG. 2 that the wand is shown in a start position, and in FIG. 3 in a finish position, between which the wand has pivoted totally across the face of the hole 36 in order to provide a film of soapy water thereacross.

The soapy water is transferred by the pump 14 from the reservoir 16 to the wand 32 by the tube 22, the exit of tube 22 being adjacent the inner face of the wand 32. The exit of tube 22 is positioned to be touching or close to the inner face of the wand 32 such that the soapy water mixture is dispensed to the inner face of the wand as it passes over the outer face of the hole 36. In particular, the soapy water mixture travels along and down the whole length of the inner face of the wand 32, and since the inner face of the wand 32 touches or is extremely close to the outer face of the hole 36, a film is formed over the whole hole 36.

In use, the trigger 12 causes at the same time, firstly soapy water to be pumped to the wand 32, and secondly rotates the rotating ring member 34 such that the wand is pivoted to cause a film to be formed across the exit hole 36. Air bubbles are then formed since the air blower 24 then blows air through the hole 36 thereby causing bubbles to be formed out of the barrel of the gun.

The toy 10 is also provided with an arrangement to return unused soapy water mixture at the vicinity of the film-making means 18 to the reservoir 16. In particular, a tube 44 is provided at the base of a compartment 46 surrounding the film-making means 18, which tube 44 enters the top of the reservoir 16.

The base of the toy 10 is also provided with an access cover 48 in which to access and replace the batteries 28.

Figure 4:
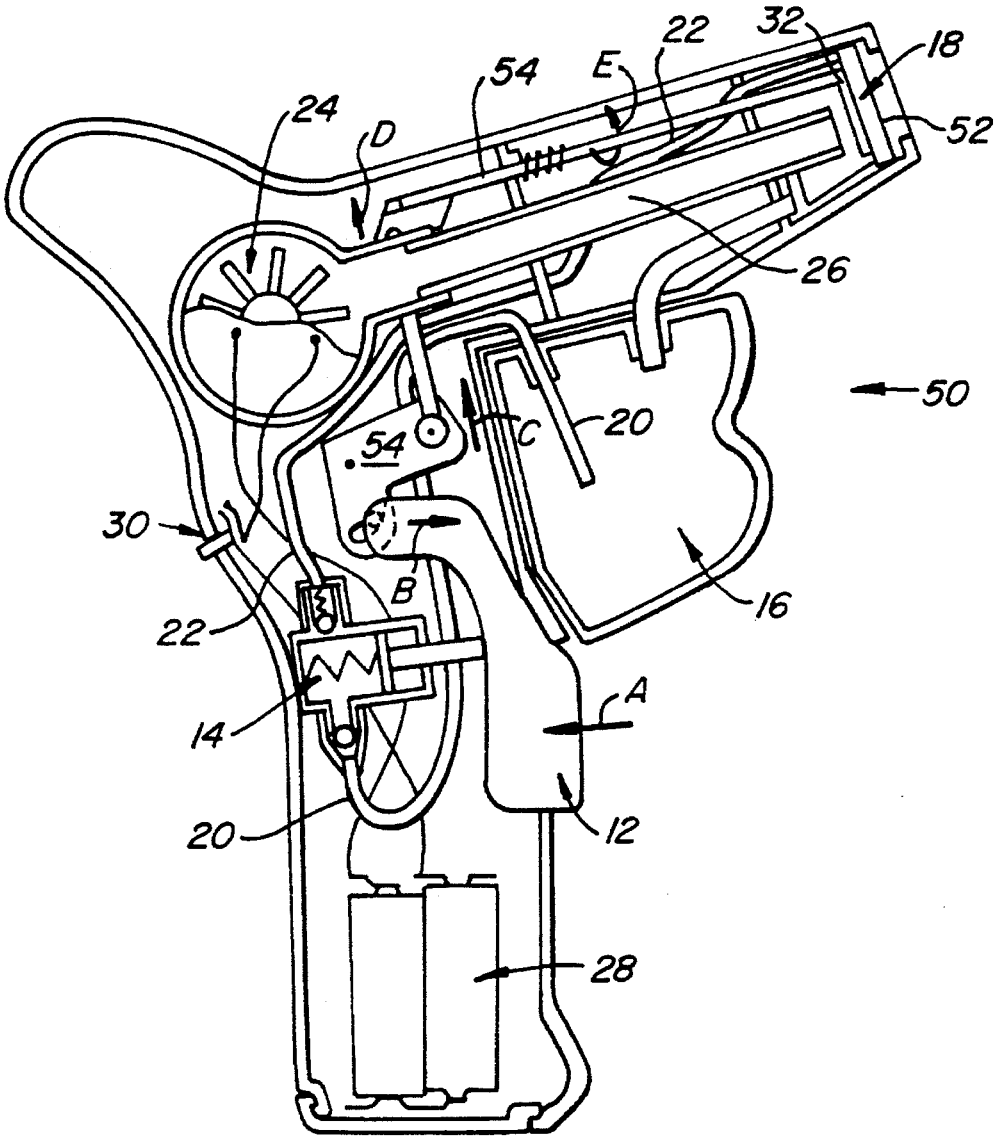
FIG. 4 shows a cross-sectional view of a second embodiment of a bubble-making gun in accordance with the invention.
Figure 5:
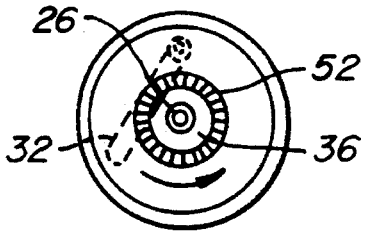
FIG. 5 shows an end view of the toy of FIG. 4 showing the pivoting element in a first position.
Figure 6:
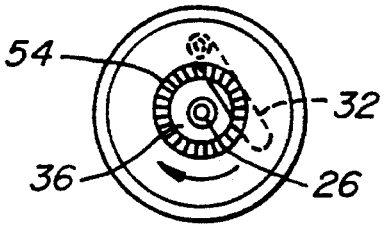
FIG. 6 shows the same view of FIG. 5 but with the pivoting element in a second position.

In FIGS. 4 to 6, a similar toy bubble-making gun 50 is shown having all the components of the toy-making gun 10 of FIG. 1 save that, instead of a rotating ring member 34 as shown in the toy of FIGS. 1 to 3, such is not necessary in the arrangement of FIGS. 4 to 6, since the wand 32 itself is pivoted across the rear face of a fixed ring member 52 incorporating the hole 36. In particular, the wand 32 is moved approximately 60° in one direction on actuation of the trigger 12, and approximately 60° back in the other direction on release of the trigger 12, since the trigger 12 operates the wand 32 via a lever system 54 as shown in FIG. 4 (see arrows A to E).

In both the toys 10 and 50 of FIGS. 1 to 6, the reservoir 16 is detachable from the rest of the toy such that the reservoir 16 can be filled with a soapy water solution. In particular, in toy 10, the reservoir 16 is connected to the rest of the toy via a clip 56.

I claim:

1. A bubble making toy comprising:

a rotatable support member;

a film support member provided in said support member and having an aperture; and means for forming a film of soap over the aperture in the film support member, said forming means including a pivoting element adapted for receiving a soapy mixture and pivotable over the face of the aperture to transfer the soapy mixture from the pivoting element to the aperture and thereby form the film of soap thereover, the aperture receiving the soapy mixture from the pivoting element only and the film of soap forming a bubble upon direction of a stream of air through the aperture.

2. A toy as claimed in claim 1 wherein the pivoting element has a length which is at least as great as the diameter of the aperture.

3. A toy as claimed in claim 1 wherein the pivoting element is pivotable from one side of the aperture completely to the other side thereof.

4. A toy as claimed in claim 1 wherein the pivoting element is secured to a point on the film support member.

5. A toy as claimed in claim 1 further including a soap reservoir and a pump for transferring soap from the soap reservoir to the pivoting element.

6. A toy as claimed in claim 1 wherein the toy is in the shape of a gun, and further includes trigger means.

7. A toy as claimed in claim 6 wherein the trigger means actuates a pump to transfer soap from a soap reservoir to the pivoting element.

8. A toy as claimed in claim 6 wherein the trigger actuates the pivoting element to pivot.

9. A toy as claimed in claim 1 wherein an air blower is provided to blow air through the aperture.

10. A toy as claimed in claim 1 wherein batteries are provided to rotate an air blower.

11. A toy as claimed in claim 9 wherein switch means are provided in order to turn on the air blower.

12. A bubble making toy comprising:

a rotatable ring having first and second sides and an aperture formed therethrough;

means for directing a soap mixture to the aperture; and a pivoting element mounted proximate to the first side of the rotatable ring, the pivoting element being pivotable over the aperture and being adapted to receive the soap mixture and to form a film of soap over the aperture.

13. The toy as claimed in claim 12 wherein the pivoting element has a length which is at least as great as the diameter of the aperture.

14. The toy as claimed in claim 12 wherein the pivoting element is pivotable from one side of the aperture completely to the other side thereof.

* * * * *